US007400837B2

(12) United States Patent
Koyama

(10) Patent No.: US 7,400,837 B2
(45) Date of Patent: Jul. 15, 2008

(54) IMAGE RECORDING APPARATUS

(75) Inventor: Tetsu Koyama, Tokyo (JP)

(73) Assignee: Oki Data Corporation, Tokyo (JP)

( * ) Notice: Subject to any disclaimer, the term of this patent is extended or adjusted under 35 U.S.C. 154(b) by 322 days.

(21) Appl. No.: 11/217,361

(22) Filed: Sep. 2, 2005

(65) Prior Publication Data

US 2006/0051110 A1 Mar. 9, 2006

(30) Foreign Application Priority Data

Sep. 3, 2004 (JP) ..... 2004-257636

(51) Int. Cl.
*G03G 15/08* (2006.01)

(52) U.S. Cl. ..... 399/27; 399/61

(58) Field of Classification Search ..... 399/9, 399/24, 27, 61, 252, 258
See application file for complete search history.

(56) References Cited

U.S. PATENT DOCUMENTS 6,931,216 B2 * 8/2005 Mochizuki et al. ..... 399/27
7,068,955 B2 * 6/2006 Yamamoto et al. ..... 399/27
7,095,964 B2 * 8/2006 Koyama et al. ..... 399/24
7,110,684 B2 * 9/2006 Isobe et al. ..... 399/27
7,146,115 B2 * 12/2006 Suzuki et al. ..... 399/27
7,162,167 B2 * 1/2007 Iida et al. ..... 399/27
7,181,147 B2 * 2/2007 Kinoshita et al. ..... 399/27
7,187,876 B2 * 3/2007 Ito et al. ..... 399/27
7,248,805 B2 * 7/2007 Hirota et al. ..... 399/27
7,269,364 B2 * 9/2007 Tanaka et al. ..... 399/27

FOREIGN PATENT DOCUMENTS

JP 11-38744 2/1999

* cited by examiner

*Primary Examiner*—Hoan H Tran
(74) *Attorney, Agent, or Firm*—Rabin & Berdo, PC

(57) ABSTRACT

This invention aims to provide an image recording apparatus capable of preventing deterioration in remaining toner detection accuracy and further to prevent toner from getting damages. To achieve the above described objects, the image recording apparatus according to this invention includes a developer supplying mechanism for supplying the developer from the developer container, a developer containing chamber for containing the developer supplied by the developer supplying mechanism, a developer amount detecting mechanism for detecting a developer amount inside the developer containing chamber, and a controller for controlling based on both a detected value detected with the developer amount detecting mechanism and a predetermined threshold value developer supplying operation using the developer supplying mechanism, in which the controller suspends the developer supplying operation using the developer supplying mechanism based on a shift in the detected values detected by the developer amount detecting mechanism in a state where the developer supplying mechanism supplies the developer.

15 Claims, 15 Drawing Sheets

IMAGE RECORDING APPARATUS

BACKGROUND OF THE INVENTION

1. Field of the Invention

This invention relates to an image recording apparatus for recording images on prescribed recording media using a developer contained in a developer container.

2. Description of Related Art

In conventional image recording apparatuses, a photosensitive drum having a uniformly charged surface thereof is exposed to light to form an electrostatic latent image, thereby attaching toner on portions of the electrostatic latent images using electrostatic force to render the images visible. The visible image attached with the toner is transferred onto the recording medium, and subsequently the toner is fused onto the recording medium when conveyed through a fuser to complete the recording operation. The above described mechanism for attaching the toner to the photosensitive drum is formed as a united body, thereby being detachably attachable to the image recording apparatus, and in some apparatuses, the unused toner container may be provided in a detachably attachable manner. This mechanism is generally referred to as a developing device and serves as a main part for making image forming operation.

In the developing device for attaching the toner to the photosensitive drum, a toner supplying mechanism for supplying the toner from the developer container is installed in the developer container and supplies the toner where the toner inside the developing device is consumed. A roller having indentations, an elastic body, a spiral shaped member, and the like had been used as the supplying mechanism. The developer container also has an agitating mechanism for agitating the developer contained inside the container. The agitating mechanism, moreover, has an agitating member which can rotate upon reception of pushing force from such an electric driving means rotating at prescribed rate and can rotatably fall without reception of driving force from the electric driving means down to a bottom position when reaching at a topmost position. Where the amount of toner remaining in the developer container decreases, this agitating member rotates immediately from the topmost position to the bottom position and remains at the bottom position until pushed by a pushing section formed to a connecting member for connecting the agitating member to the driving means. If toner of a large amount remains, the agitating member rotates slowly from the topmost position to the bottom position due to resistance force of the toner, thereby rotating to the bottom position upon reception of the pushing force from the pushing section. Consequently, the amount of toner remaining inside the developer container can be detected upon measurement of period during which the agitating member remains at the bottom position.

More specifically, Japanese Patent Application Publication No. H11-38,744 has been disclosed as an art for detecting the amount of remaining toner.

For more details, described in Japanese Patent Application Publication No. H11-38,744 is that an agitating shaft composed of a first rectangular convex shaped portion, a second rectangular convex shaped portion, and a rotating shaft is formed in a crank shape so that the first and second rectangular convex shaped portions have a 180-degree difference in phase with respect to the rotating shaft as a center, in which the first and second rectangular convex shaped portions are different from each other in weight and in which the remaining toner amount is detected according to a period during which either the first or second rectangular convex shaped portion is positioned at a bottom position.

However, there raises problem such that the amount of actually remaining toner and the remaining amount of toner detected based on a period during which the agitating member is positioned at the bottom position are not identical to each other due to deviation in the toner profile inside the developer container at a time of supplying operation. For example, the agitating member falls fast from the topmost position to the bottom position and remains at the bottom position for a longer time where the toner is distributed not uniformly despite the remaining toner of a greater amount than a certain ideal value. In such a case, there raises a problem that the supplying operation is undesirably started despite the remaining toner of a greater amount than a certain ideal value, immediately after a controller for controlling the supplying operation confirms that a period during which the agitating member is positioned at the bottom position is shorter than a threshold value. Furthermore, such a trouble such that the detection accuracy for the remaining toner amount deteriorates, is undesirably caused where a period serving as the threshold value is set longer than needed to prevent the above described situation from occurring.

Furthermore, in the above case, deviations may occur in the toner profile and the supplying toner amount, thereby resulting in deviations in the amount of toner remaining inside the developer container caused by the deviations in the amount of supplying toner, where the controller suspends the supplying operation immediately after making a judgment that a period during which the agitating member remains at the bottom position is less than the threshold value. Where the deviations occur in the amount of toner remaining inside the developer container, there raises a problem such that the calculation accuracy is impaired and such that the toner supplying operation is improperly resumed despite the remaining toner of a sufficient amount inside the developer container due to erroneous recognition of the controller with respect to the remaining toner amount.

This invention is made in consideration of the above described background, and it is an object of the invention to provide an image recording apparatus capable of avoiding deterioration in the remaining toner detection accuracy.

SUMMARY OF THE INVENTION

To achieve the above described object, an image recording apparatus according to this invention comprises a developer supplying mechanism for supplying the developer from the developer container, a developer containing chamber for containing the developer supplied by the developer supplying mechanism, a developer amount detecting mechanism for detecting a developer amount inside the developer containing chamber, and a controller for controlling based on both a detected value detected with the developer amount detecting mechanism and a predetermined threshold value developer supplying operation using the developer supplying mechanism, in which the controller suspends the developer supplying operation using the developer supplying mechanism based on a shift in the detected values detected by the developer amount detecting mechanism in a state where the developer supplying mechanism supplies the developer.

With the above described structure, the controller detects the approximate amount of the developer remaining inside the developer containing chamber using the developer amount detecting mechanism to start the developer supplying operation using the developer supplying mechanism upon comparison between a detected result and a predetermined threshold value, and subsequently suspends the developer supplying operation based on a shift in the detected values, not based on a comparison result between a detected value and a threshold value after recognition of the status that the developer inside the developer containing chamber detected by the developer amount detecting mechanism exceeds a certain amount in the developer containing chamber. That is, the controller suspends the developer supplying operation using the developer supplying mechanism upon recognition of the stable status of the remaining developer amount inside the containing chamber.

To achieve the above objects, the developer amount detecting mechanism of the image recording apparatus according to this invention is characterized in having agitating mechanism for agitating the developer inside the developer containing chamber and an operation detector for detecting operation of the agitating mechanism, in which a judgment as to the remaining developer amount is made based on a detected result by the operation detector.

The agitating mechanism of the image recording apparatus according to this invention is also characterized in having an agitating member which can rotate upon reception of pushing force in a rotating direction of a driving unit rotating at certain rate and rotatably fall without reception of the driving force from the driving unit down to a bottom position when positioned at a topmost position, and a pushing section capable of pushing the agitating member to a connecting member for connecting the agitating member to the driving unit.

With the above described structure, the agitating member rotates to the bottom position immediately after moved up to the topmost position and subsequently remains at the bottom position in a case of the remaining developer of a small amount inside the developer containing chamber, while the agitating member rotates slower to the bottom position ascribable to resistance force by the developer in a case of the remaining developer of a large amount inside the developer containing chamber. That is, the amount of developer remaining inside the developer containing chamber can be approximately detected upon detection of a period during which the agitating member remains at the bottom position.

To achieve the above objects, the operation detector of the image recording apparatus according to this invention has a feature having a sensor for sensing a period during which the agitating member remains at the bottom position, in which the controller makes a comparison between a period sensed by the sensor, during which the agitating member remains at the bottom position and the threshold value.

With the above described structure, an approximate amount of developer can be recognized upon comparison between a sensed period and a previously memorized threshold value since a period during which the agitating member remains at the bottom position changes according to the developer amount inside the developer containing chamber. The controller gives a supplying start instruction to the developer supplying mechanism based on a recognized result. During the supplying operation, the comparison operation as described above is also made repeatedly upon sensing a period during which the agitating member remains at the bottom position. The controller can also give a supplying suspend instruction to the developer supplying mechanism based on a result of the comparison operation made during the supplying operation.

According to this invention, the image recording apparatus for recording an image to a prescribed recording medium using a developer contained in a developer container comprising a developer supplying mechanism for supplying the developer from the developer container, a developer containing chamber for containing the developer supplied by the developer supplying mechanism, a developer amount detecting mechanism for detecting a developer amount inside the developer containing chamber, and a controller for starting developer supplying operation using the developer supplying mechanism based on both a detected value detected with the developer amount detecting mechanism and a predetermined threshold value and for suspending, after continuation of the developer supplying operation, the supplying operation of the developer in a predetermined amount after the detected value detected with the developer amount detecting mechanism becomes equal to the predetermined threshold value.

With the above described structure, the controller does not suspend immediately but continues the developer supplying operation in the predetermined amount after the developer amount detecting mechanism detects the predetermined threshold value. Errors occurs in the developer amount detected using the developer amount detecting mechanism due to developer profile inside the developer containing chamber where the controller suspends the developer supplying operation when detecting the predetermined threshold value using the developer amount detecting mechanism. Such errors as resulted from the developer profile, however, can be prevented upon supplying the developer in the predetermined amount subsequently after the developer amount detecting mechanism detects the developer amount equal to the predetermined value.

According to this invention, the supplying operation is not suspended immediately after confirmation of the status that developer exceeds a certain amount inside the developer containing chamber, but can be suspended upon confirmation of the stable status of the remaining developer amount inside the containing chamber. Therefore, this invention can avoid deterioration in the remaining toner amount detection accuracy.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DETAILED DESCRIPTION OF PREFERRED EMBODIMENTS OF THE INVENTION

Hereinafter, specific embodiments with application of this invention are described in detail in reference to drawings.

Figure 1:
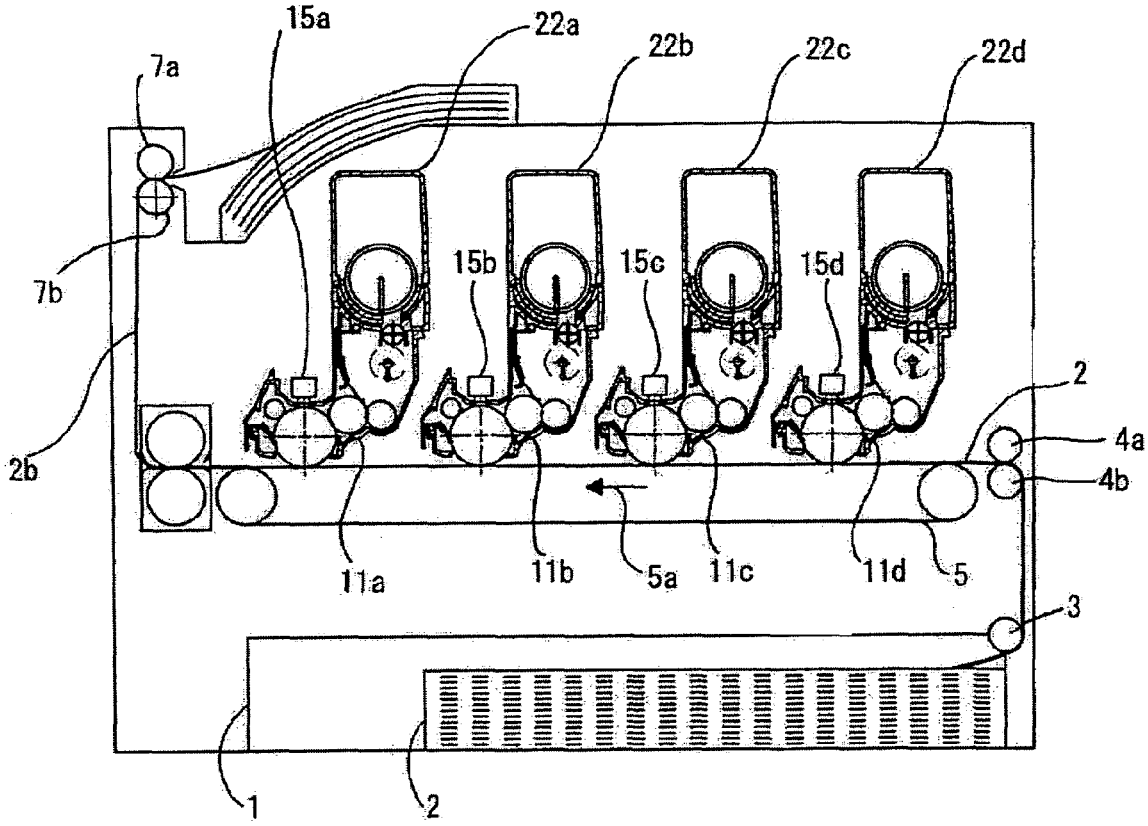
FIG. 1 is a cross-sectional view showing an image recording apparatus according to the first and second embodiments.
Figure 2:
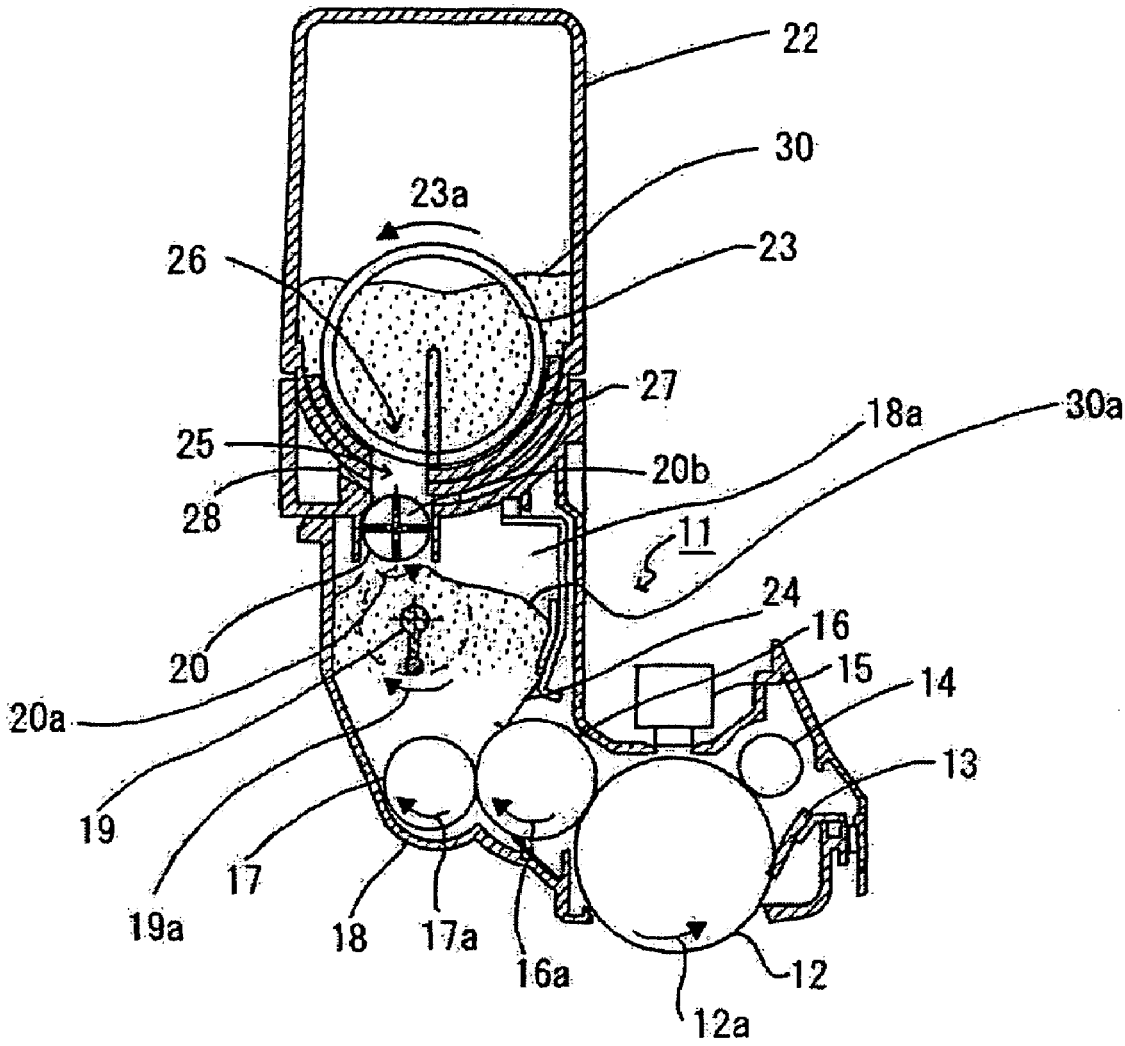
FIG. 2 is a front cross-sectional view showing a developing device according to the first and second embodiments.
Figure 3:
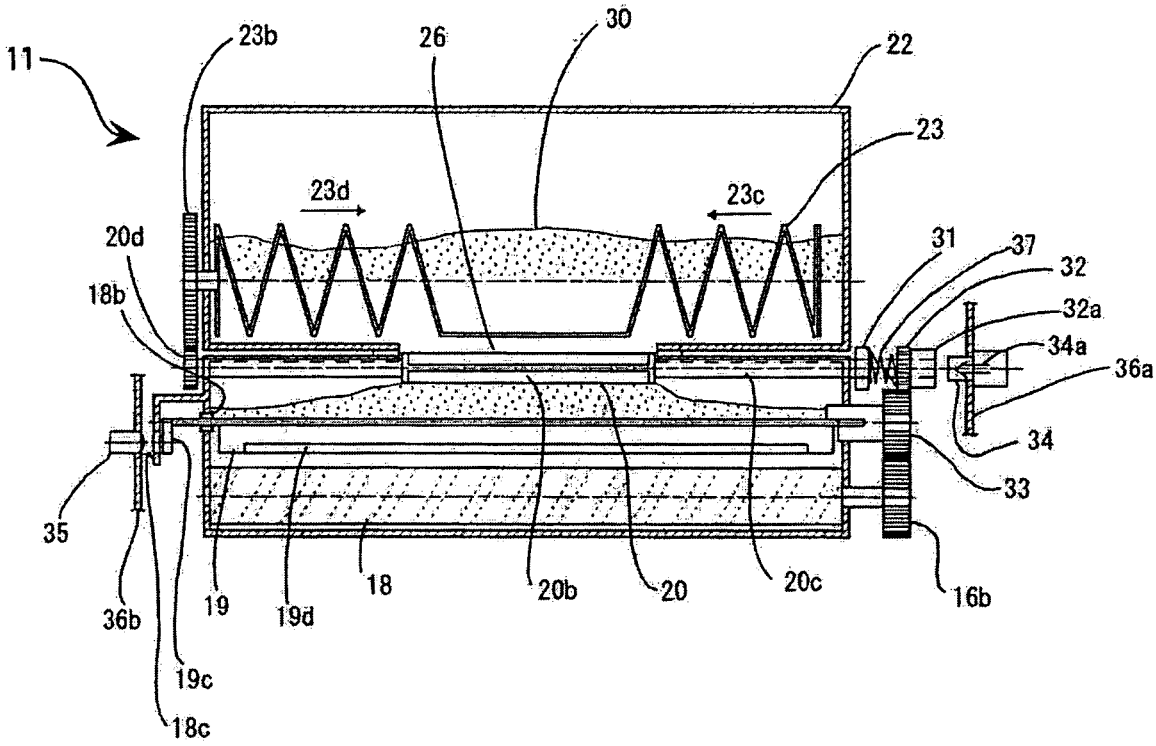
FIG. 3 is a side cross-sectional view showing the developing device according to the first and second embodiments.
Figure 4:
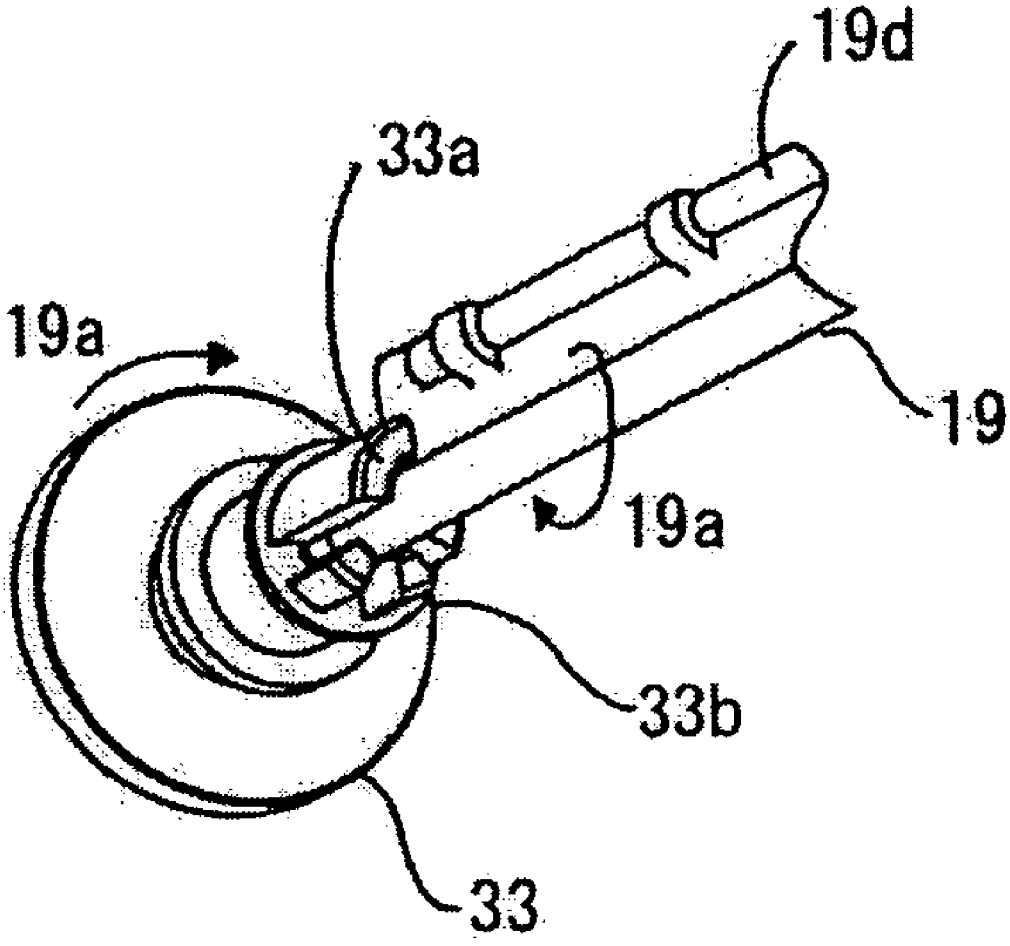
FIG. 4 is a perspective view showing an agitating member according to the first and second embodiments.
Figure 5:
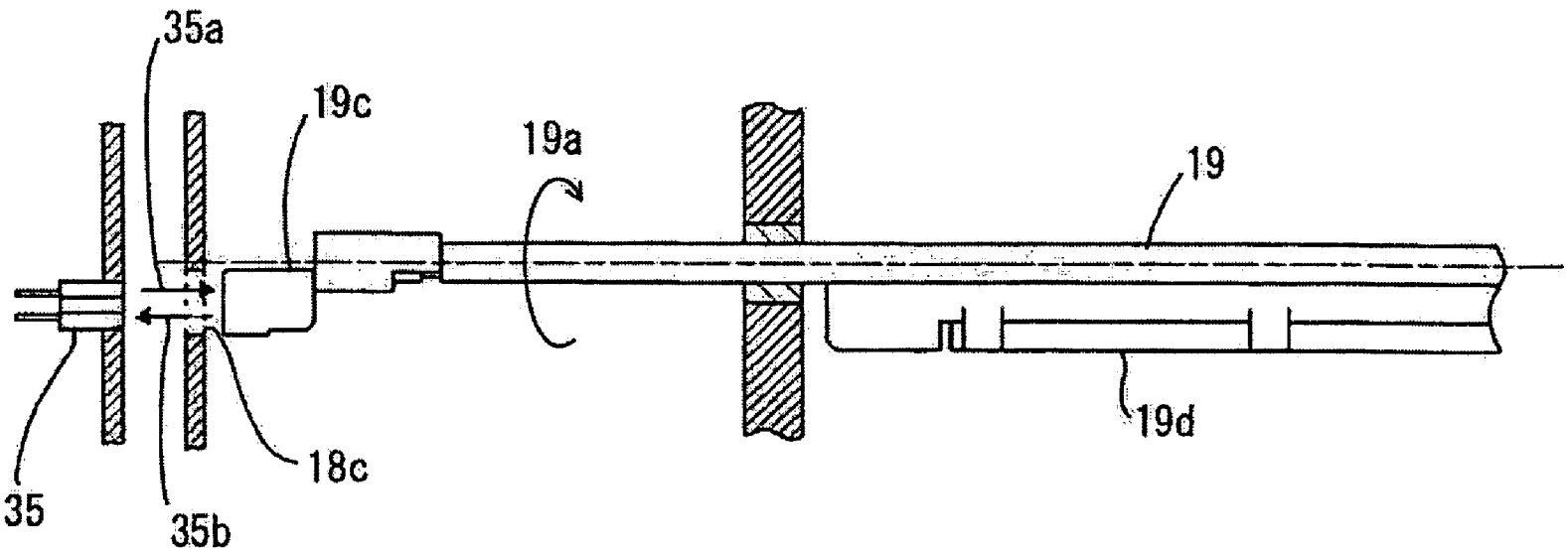
FIG. 5 is a detailed view showing the agitating member according to the first and second embodiments.
Figure 6:
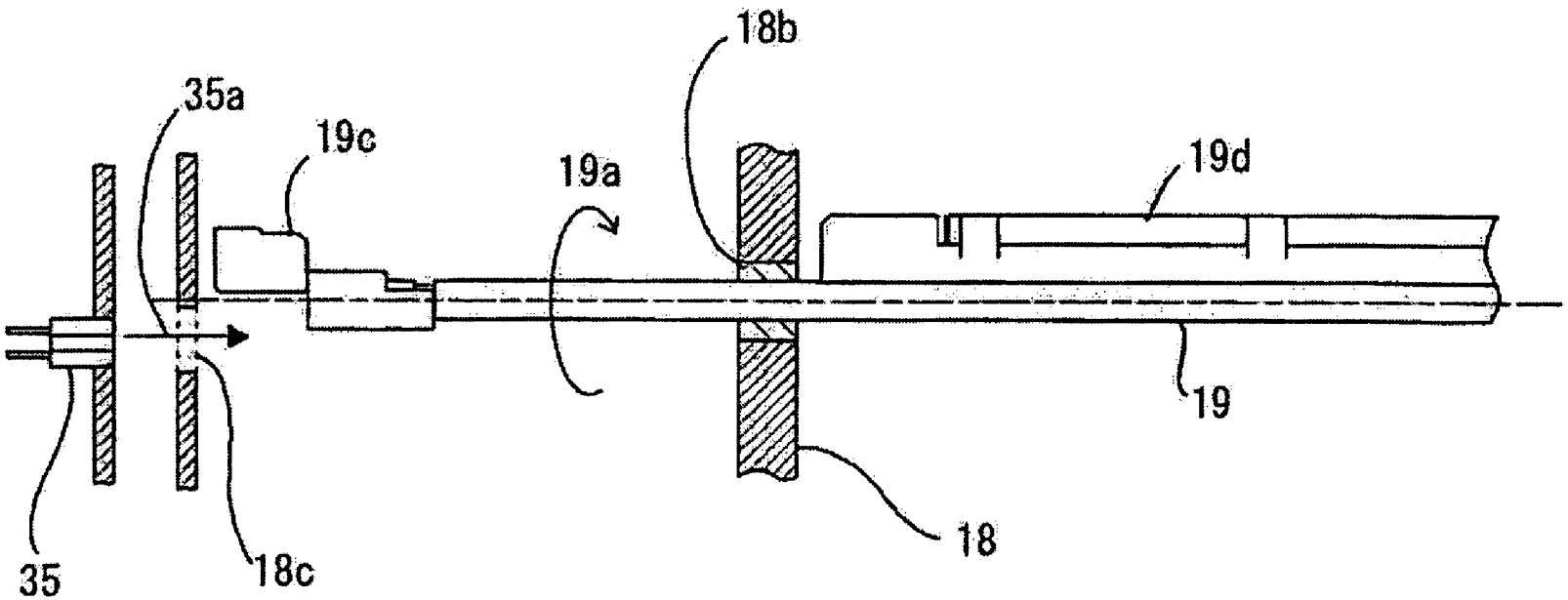
FIG. 6 is a detailed view showing the agitating member according to the first and second embodiments.

FIG. 1 is a cross-sectional view showing an image recording apparatus according to the first embodiment; FIG. 2 is a front cross-sectional view showing a developing device according to the first embodiment; FIG. 3 is a side cross-sectional view showing the image recording apparatus according to the first embodiment; FIG. 4 is a perspective view showing an agitating member according to the first embodiment; and FIG. 5 and FIG. 6 are detailed views showing the agitating member according to the first embodiment.

As shown in FIG. 1, the image recording apparatus according to the first embodiment capable of printing in multicolor has developing devices 11*a*, 11*b*, 11*c*, 11*d* for developing images in colors of yellow, magenta, cyan, and black, respectively. The developer containing chambers disposed in the developing devices 11*a*, 11*b*, 11*c*, and 11*d* contain the developers in yellow, magenta, cyan, and black colors, respectively, in which the developers in those colors are respectively supplied from developer containers 22*a*, 22*b*, 22*c*, 22*d* disposed at upper portions of the developing devices 11*a*, 11*b*, 11*c*, 11*d*.

The image recording apparatus separates recording media 2 sheet by sheet in using a separating roller 3 and then moves the recording medium 2 on a transfer unit 5 in using transfer rollers 4*a*, 4*b* where receiving a printing instruction from an external device, not shown. At this time, the image recording apparatus exposes and charges a photosensitive drum, not shown, in using four print heads 15*a*, 15*b*, 15*c*, 15*d*, thereby forming an electrostatic latent image on a surface of the photosensitive drum. Subsequently, the image recording apparatus attaches upon charging, the toner stored in the developer containers 22*a*, 22*b*, 22*c*, 22*d* to the electrostatic latent image, thereby transferring this toner image onto the recording medium 2 with static electricity in using the transfer unit 5. The image recording apparatus forms an image by fusing the toner image on the recording medium 2 in using a fusing unit 6 when conveying the recording medium 2 transferred with the unfused toner to the fusing unit 6. The image recording medium discharges the recording medium 2 to an exterior in using discharge rollers 7*a*, 7*b* where forms the image on the recording medium 2 in the above described manner.

Hereinafter, constructional elements composing the developer supplying mechanism and the developer containing chamber are described in reference to FIG. 2, FIG. 3, and FIG. 4.

In FIG. 2, a developer container 22 stores toner 30 and is disposed in a detachably attachable manner to the developing device 11. The developer supplying mechanism is composed of a toner conveyance spiral 23, a toner blocking wall 27 of the developer container, a supplying opening 26, and a supplying regulating member 20. The toner blocking wall 27 blocks the supplying opening 26 of the developer container to prevent the toner from falling dawn before mounted to the developing device 11. The developing device 11 is composed of an outer wall 18 and stores inside the toner. The supplying opening 26 is formed in a longitudinal direction at the upper portion of the developing device 11. The toner supplying regulating member 20 is placed in a rotatable manner at an inner position of the supplying opening 26 and has one or more indentations to receive the toner. A toner hopper 18*a* serves as the developer containing chamber for storing temporally the toner supplied from the developer container 22 through the supplying opening 26. The toner hopper 18*a* has inside an agitating member used with a developer detector. The agitating member is detected by an operation detector formed outside the toner hopper 18*a* to rotatably fall freely from a topmost position in a case of the remaining toner of a small amount.

The supplying roller 17 is rotated in a direction of an arrow 17*a* by a driving source, not shown, to supply the toner 30 on the developing roller 16. The developing roller 16 is also rotated in a direction of an arrow 16*a* by the driving source, not shown, and consequently the toner 30 supplied by the supplying roller 17 is formed in a thin layer form by a developing blade, thereby being charged. Subsequently, the print head 15 exposes a surface of the photosensitive drum 12 charged by the charging roller 14, thereby lowering electric potential on the exposed portion to nearly zero volt, so that the exposed portion is developed upon reception of the toner from a contact portion to the developing roller 16 as the photosensitive drum 12 is rotated in the direction of the arrow 12*a*. Furthermore, the toner attached onto the photosensitive drum 12 is transferred to the recording medium and thereafter the toner remaining on the photosensitive drum 12 is removed by a cleaning blade 13 disposed in contact with the upper portion of the photosensitive drum 12.

In FIG. 3 and FIG. 4, the image recording apparatus is composed of the developing roller 16, a gear 16*b* for rotating the developing roller 16, a gear 33 for rotating an agitating member 19 composing the agitating mechanism from the topmost position to the bottom position, a pushing member 33*a* in contact with a part of the agitating member 19, a dog clutch receiving part 31 secured with a shaft 20*c* as a shaft coupled to the toner supplying regulating member, and a male element 34 and a female member 32*a* formed as in mesh with each other's concaved and convex shapes. Furthermore, a gear 20*d* is secured to one end of the shaft 20*c*. The female element 32*a* is defined as a projection formed as projecting from the developing device 11 and connected through an elastic body 33 to one portion of a dog clutch moving part 32 serving as a pair with the dog clutch receiving part 31. The male element 34 is placed with a gap in a horizontal direction of the female member 32*a* using a pushing post and is secured to an inner wall 36*a* of the image recording apparatus.

Hereinafter, constructional elements composing the developer amount detecting mechanism is described in reference to FIG. 4, FIG. 5, and FIG. 6.

The agitating member 19 is formed upon securing a blade shaped member having a prescribed surface area to a stick shaped member serving as a rotating shaft of the agitating member 19. The gear 33 described below is secured to one end of the stick shaped member, and the blade shaped member is formed to an intermediate portion of the stick shaped member. Those portions of the stick shaped member are disposed inside the developer containing chamber while the other end of the stick shaped member is disposed outside the developer containing chamber through the opening formed at a wall of the developer containing chamber. That is, the agitating member 19 is disposed in a manner to penetrate the developer containing chamber. Furthermore, a reflecting plate 19*c* composed of, e.g., an SUS plate or the like having high optical reflectivity is secured to the other end of the stick shaped member. The above described opening formed in the wall of the developer containing chamber is in a size enough to allow the stick shaped member of the agitating member 19 to be loosely inserted therethrough. The stick shaped member of the agitating member 19 is loosely inserted in the opening as described above, and a sealing member 18*b* for sealing a gap between the stick shaped member and an inner circumferential surface of the opening is formed in the opening. Furthermore, a reflection sensor 35 is secured to the inner wall 36*b* of the image recording apparatus at an outside of the developing device 11.

As shown in FIG. 4, the gear 33 is rotated in a direction of an arrow 19*a* upon reception of driving force from the gear 16*b*, so that the pushing section 33*a* rotates to push the agitating member, where the toner reduces less than or equal to a prescribed amount inside the toner hopper 18*a* of the developing device 11*a*. The agitating mechanism is composed of the agitating member 19 having a weight 19*d* at a front end. The agitating member 19 falls down without reception of the driving force from the driving unit and reaches the bottom position earlier than the pushing section 33*a* at a time of reaching the topmost position 19. In this bout, the reflecting plate 19*c* secured to the agitating member 19 rotates in substantially the same manner as shown in FIG. 5, and light 35*a* emitted by the reflection sensor 35 transmits through a window 18*c*, thereby being reflected by the reflecting plate 19*c*, so that the reflection sensor 35 senses reflected light 35*b*. However, the light 35*a* emitted by the reflection sensor 35 transmits through the window 18*c* but is not reflected by the reflecting plate 19*c*, neither does the reflection sensor 35 sense the reflected light 35*b*, as shown in FIG. 6. The agitating member 19 falls without reception of the driving force from the driving unit and remains at the bottom position for a longer period in a case of the remaining toner of a small amount inside the toner hopper 18*a*. On the other hand, in a case of the remaining toner of a sufficient amount inside the toner hopper 18*a*, the agitating member 19 is prevented by resistance force of the toner 30 from falling down without reception of the driving force from the driving unit and therefore remains above the toner 30 until when pushed by the pushing section 33*a*, thereby remaining at the bottom position for a shorter period. Consequently, the image recording apparatus can recognize the remaining toner amount inside the toner hopper 18*a* upon sensing difference in those periods in using the reflection sensor 35.

Described hereinafter is operation of the developer supplying mechanism made in a case where the image recording apparatus makes a judgment of the remaining toner of an insufficient amount inside the toner hopper 18 based on a below described judging unit and a controller, as a result of recognition of the approximate remaining toner amount inside the toner hopper 18*a* in using the above described developer amount detecting means.

The controller described below gives a supplying start instruction where the image recording apparatus makes a judgment that the remaining toner is in an insufficient amount. Subsequently, the male element 34 is displaced in a direction of an arrow 34*a* in FIG. 3 to come in contact with the female element 32*a*. The female element 32*a* is then slid in the direction of the arrow 34*a*, so that the dog clutch moving part 32 such as rotatable in association with the female member 32*a* is coupled to the dog clutch receiving part 31. The dog clutch receiving part 31 is secured to the supplying regulating member 20 placed at a lower portion of the supplying opening 26 of the developer container 22, in which the supplying regulating member 20 is rotated in a direction of an arrow 20*a* in association with rotation of the dog clutch receiving part 31 to supply the toner 30 into the toner hopper 18*a*. At this time, the conveyance spiral 23 secured to the gear 23*b* is rotated simultaneously through the gear 23*b* placed at an upper portion of the gear 20*d*, in association with rotation in the direction of the arrow 20*a*, likewise the supplying regulating member 20, of the gear 20*d* placed at an end portion of the shaft 20*c* connected to the supplying regulating member 20. The toner does not run short at the vicinity of the supplying opening 26 since the conveyance spiral 23 is placed in a direction to convey the toner toward the supplying opening 26, or namely in a direction of arrows 23*c*, 23*d*.

As described above, all of the dog clutch receiving part 31, the supplying regulating member 20, and the conveyance spiral 23 receive driving force from the gear 33 through the dog clutch moving part 32. To be specific, where the male element 34 is separated from the dog clutch moving part 32 when the controller described later gives the supplying suspend instruction, the dog clutch moving part 32 and the dog clutch receiving member 31 are separated from each other due to resilience of the elastic body 37. As a result, driving force is not transmitted from the gear 33 to any of the dog clutch moving part 31, the supplying regulating member 20, and the conveyance spiral 23, so that the image recording apparatus suspends the supplying operation.

Figure 7:
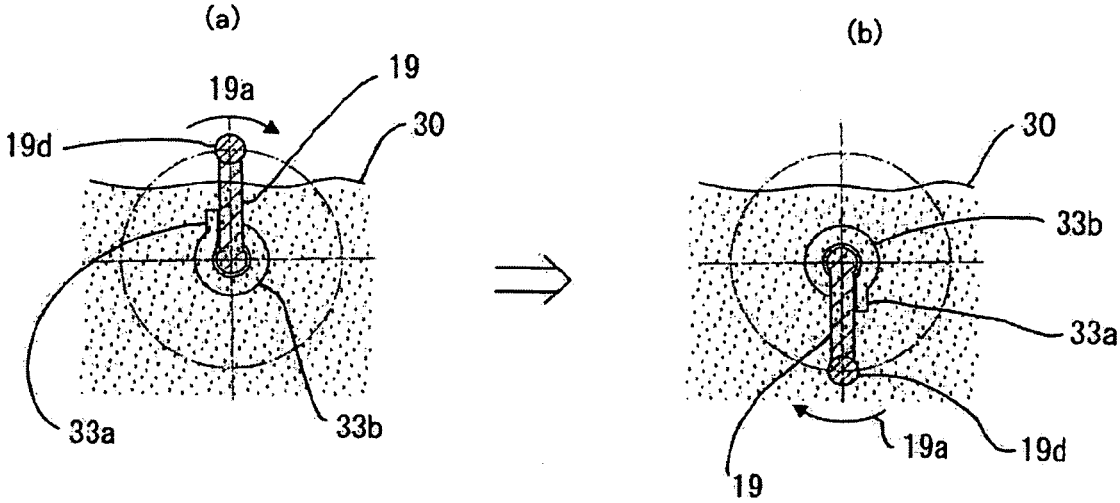
FIG. 7 is a detailed view illustrating operation of the agitating member according to the first and second embodiments.
Figure 8:
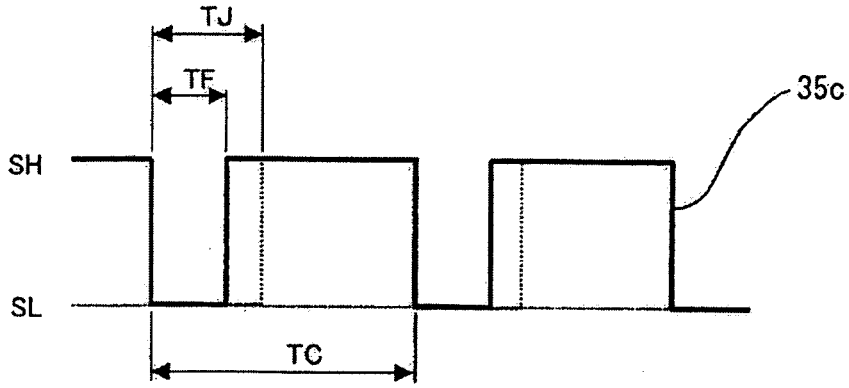
FIG. 8 is a waveform showing an output signal according to the first and second embodiments.
Figure 9:
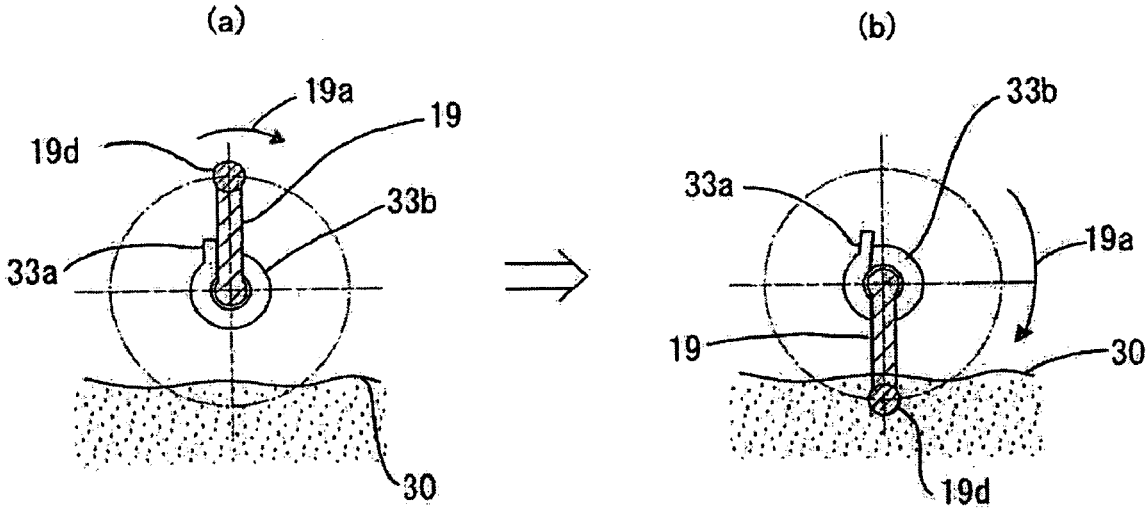
FIG. 9 is a detailed view illustrating operation of the agitating member according to the first and second embodiments.
Figure 10:
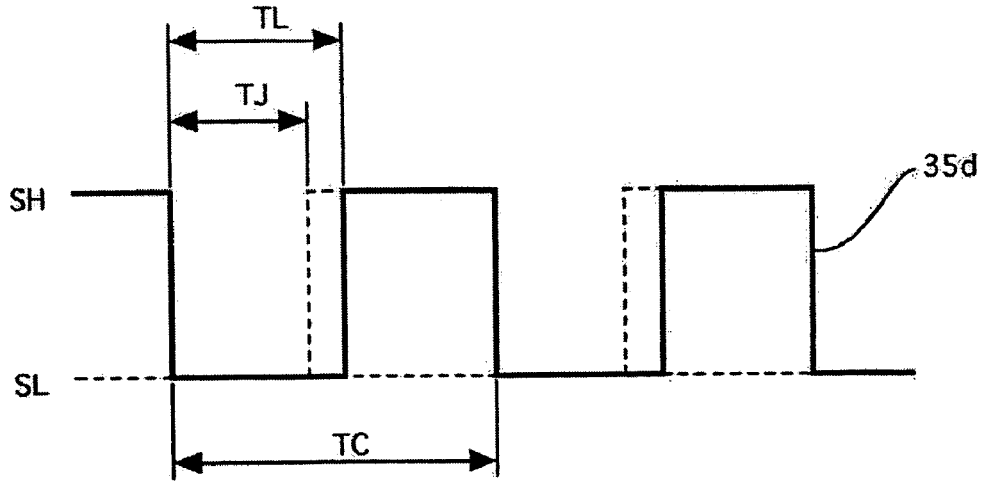
FIG. 10 is a waveform showing an output signal according to the first and second embodiments.

During the toner supplying operation as described above, the agitating member 19 remains at the bottom position for a shorter period in a case of the remaining toner of a large amount since the agitating member 19 is rotated from the topmost position to the bottom position in synchrony with the pushing section 33*a* as shown in FIG. 7(*a*) and FIG. 7(*b*). A waveform as shown in FIG. 8 is an output signal 35*c* of the reflection sensor 35. On the condition that a high level output signal (hereinafter described as an SH signal) indicates a status that the reflected light cannot be sensed while a low level output signal (hereinafter described as an SL signal) indicates a status that the reflected light can be sensed, an SL signal time T is indicated by TF in FIG. 8. In this bout, where TJ indicates a threshold value of a time T during which a judgment is made as to whether the toner remaining inside the toner hopper 18*a* is of a small amount, inequality of TF<TJ is satisfied. Furthermore, where the toner remaining in the toner hopper 18*a* is of a small amount, the agitating member 19 remains at the bottom position for a longer period since rotated as shown in FIG. 9(*b*), from the topmost position to the bottom position faster than the pushing section 33*a*. At this time, where the SL signal time T is indicated by TL on an output signal 35*d* as shown in FIG. 10, inequality of TL>TJ is satisfied. Herein, TC is a waveform cycle of an output signal 35*d* as well as indicates a rotation cycle of the gear 33 and the pushing section 33*a*.

Hereinafter, a method for determining the threshold TJ is described in reference to FIG. 11.

Figure 11:
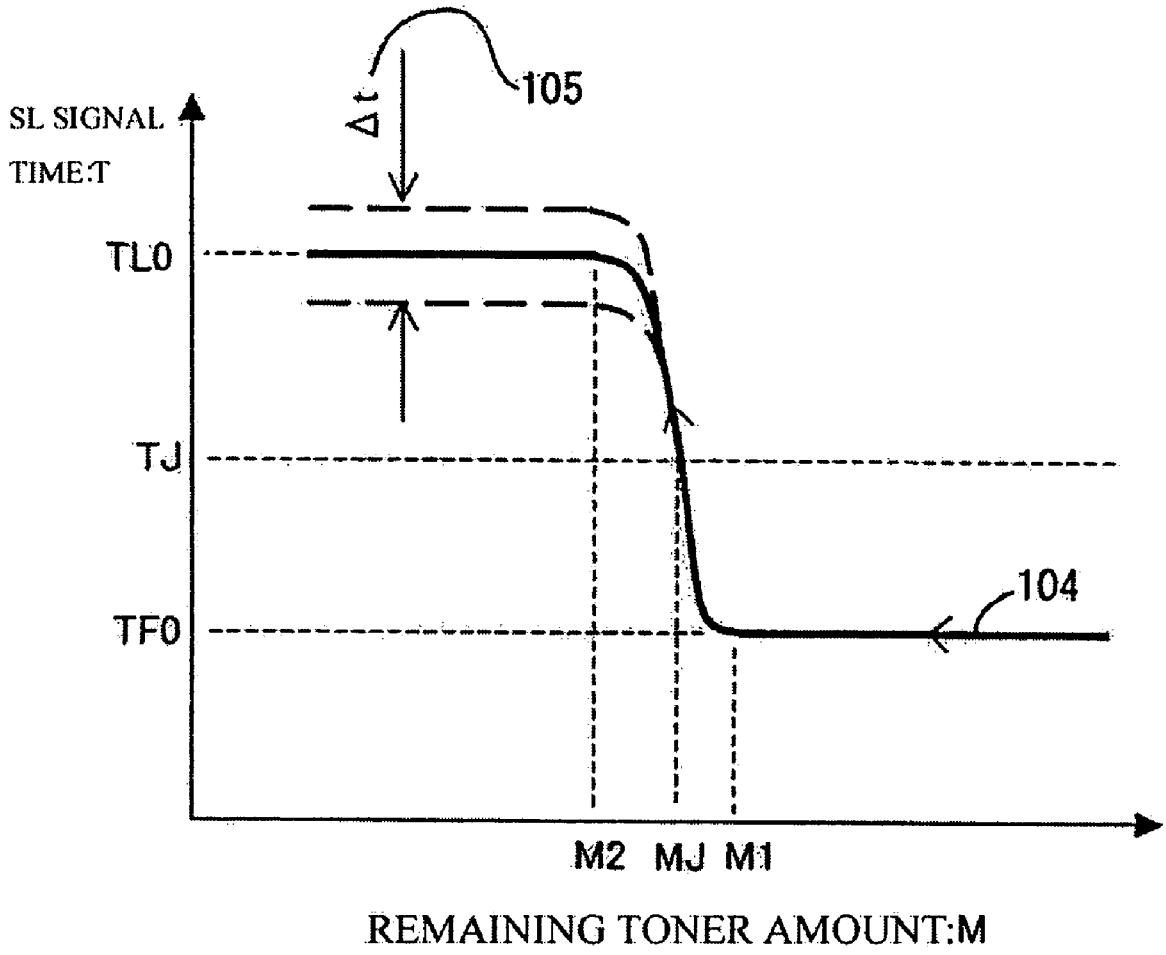
FIG. 11 is a chart showing a relation between an SL signal time and the amount of toner remaining inside a toner hopper according to the first and second embodiments.

On the condition that the amount of toner remaining inside the toner hopper 18*a* is defined as M, a relation between the remaining toner amount M and the SL signal time T is indicated by a curved line 104 such as shown in FIG. 11. That is, the SL signal time T includes a stable time TLO at the time of the remaining toner M of a small amount and a stable time TFO at the time of the remaining toner M of a large amount. Where the toner inside the toner hopper 18*a* is consumed, when the toner remaining amount on the threshold value TJ is set to MJ on the condition that an inflection point of the stable stage TFO is set to (M1, TFO) while an inflection point of the stable stage TFO is set to (M2, TLO), inequality of M2<MJ<M1 is satisfied. Herein, any error is not observed in the stable time TFO since the stable time TFO is equal to the rotation period of the pushing section 33*a* while the stable time TFO does not always stay a certain value since the agitating member 19 falls spontaneously and receives extremely weak resistance force from the toner, with which the agitating member 19 still can reach the bottom position.

It is therefore necessary to consider that an error, i.e., Δt, is observed in the stable time TLO. Consequently, the threshold value TJ is to be set out of region 105 of the error Δt.

Figure 12:
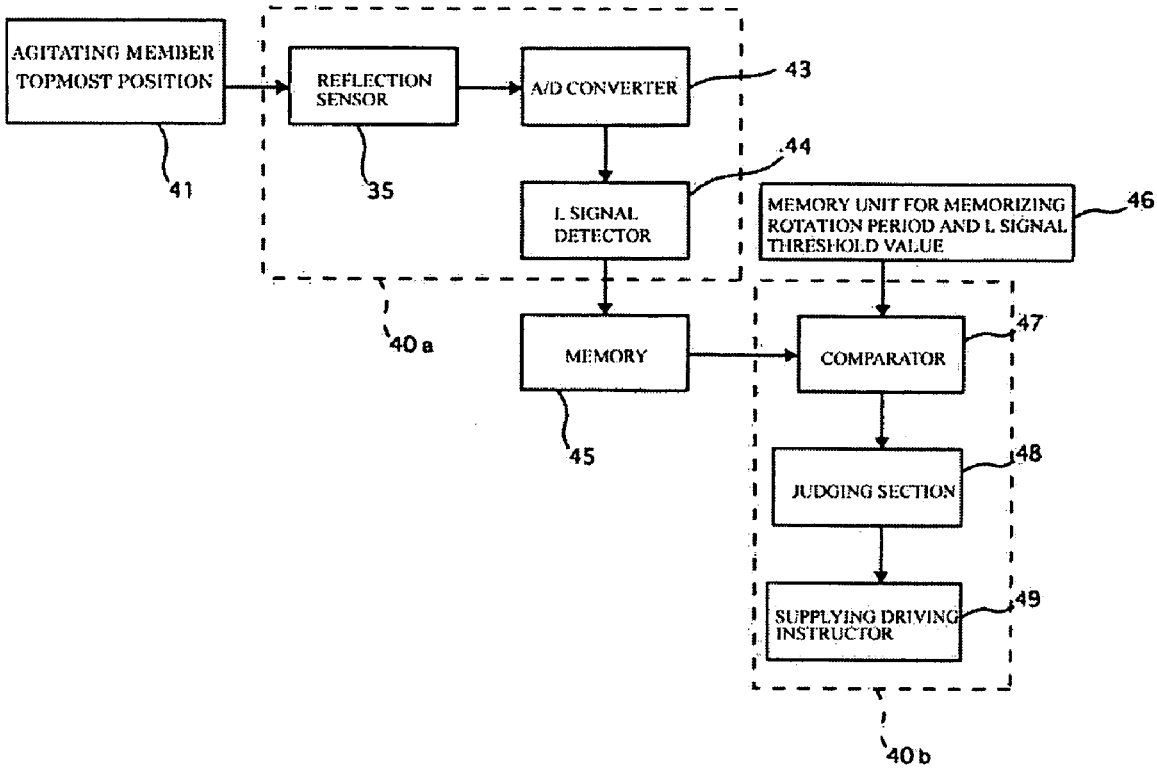
FIG. 12 is a control block diagram of a reflection sensor according to the first and second embodiments.

Next, a control structure of the reflection sensor is described in reference to FIG. 12.

The signal is converted into the SH signal and the SL signal where the reflection sensor reads a position 41 of the bottom position at which the agitating member is positioned, and subsequently an SL signal detector 44 detects a period during which the agitating member remains at the bottom position. Furthermore, a memory 45 memorizes the SL signal time, so that a comparator 47 makes a comparison between the threshold value read from an SL signal threshold value memory 46 and an SL signal time stored in the memory 45. The judging unit 48 makes a judgment based on the comparison result as to whether the toner remaining inside the toner hopper 18*a* is of a large or small amount. Where the remaining toner of a small amount is judged as a result of the judgment, a supplying driving instructor 49 gives the supplying start instruction to start the toner supplying operation.

Figure 13:
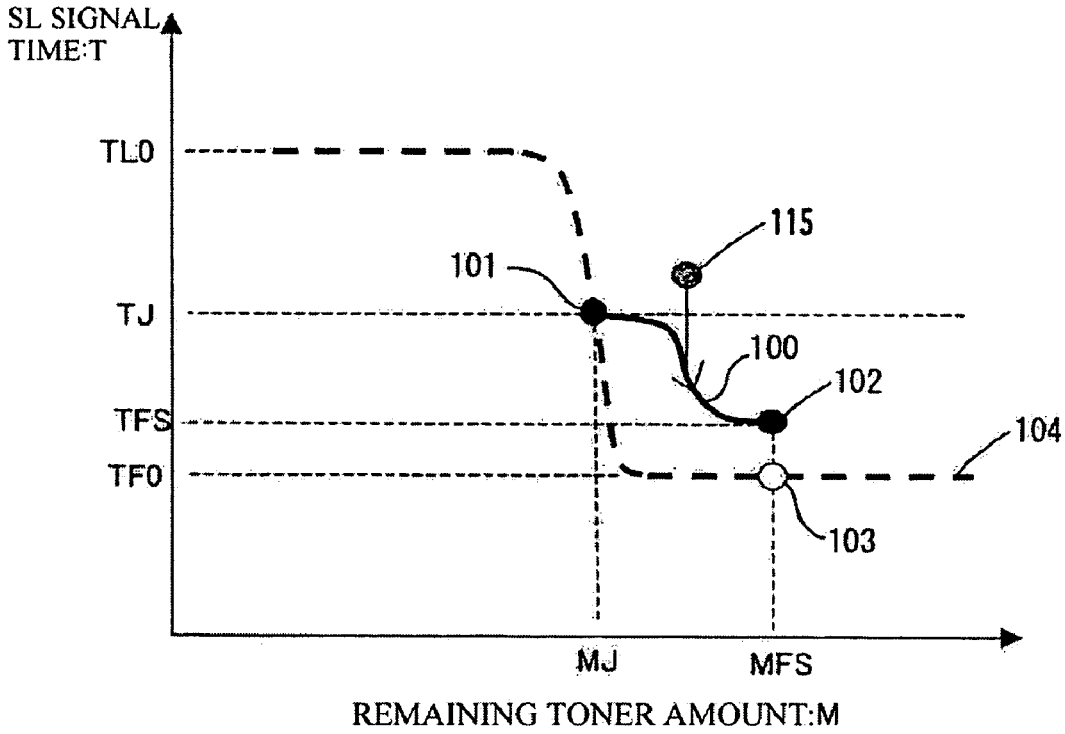
FIG. 13 is a chart showing a relation between the amount of toner remaining in a toner hopper and an SL signal time during toner supplying operation according to the first embodiment.

The toner supplying operation is made in a case of the remaining toner of a small amount. A relation between the remaining toner amount and the SL signal time during the toner supplying operation is shown in FIG. 13. A curved line 100 indicates the relation during the toner supplying operation. The toner supplying operation is started at the time that the SL signal time T is equal to the threshold value TJ and the curved line 100 in FIG. 13 shifts on a certain SL signal time TFS after certain period, thereby being able to suspend the toner supplying operation at this time. Where the toner supplying operation is suspended before the SL signal time TFS passes, the curved line 100 runs unstably to shift to a point 115 sharply so the SL signal time T as to exceed the threshold value TJ since the toner is not yet dispersed uniformly in the toner hopper 18*a*. Consequently, the toner supplying operation is undesirably started again, so that the toner is not supplied stably. The curved line 100 shifts to a point 103 since the toner dispersion is gradually uniformed inside the toner hopper 18 after toner supplying is suspended at the time that the SL signal time is equal to TFS while the toner remaining amount is equal to MFS.

Figure 14:
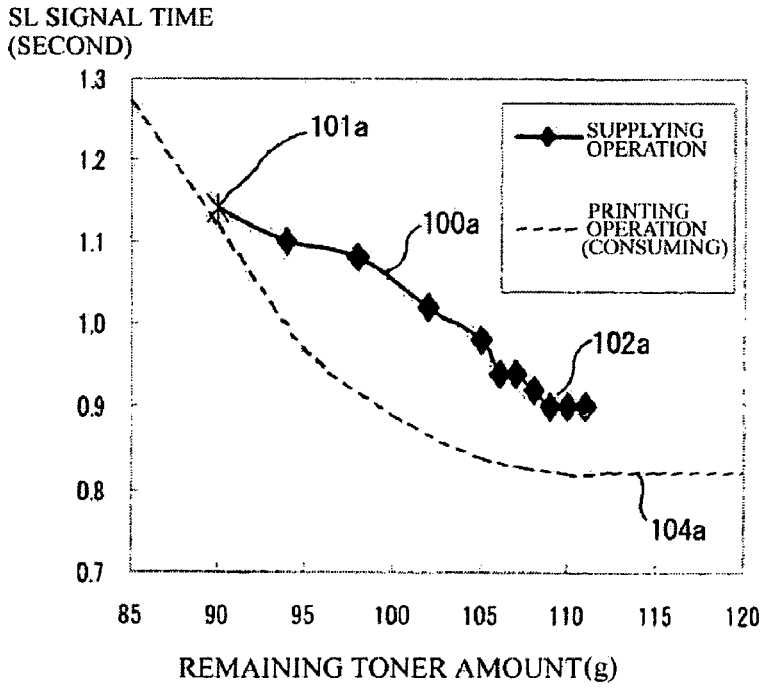
FIG. 14 is a chart showing a relation between the amount of toner remaining in the toner hopper and an SL signal time during toner supplying operation according to the first embodiment.

Shown in FIG. 14 is Experimental data in which a relation between the SL signal time and the toner remaining amount is recorded. Detailed experimental results are also shown in table 1.

TABLE 1

| toner supply status | TC after toner supply | SL signal time | the number of times that SL signal time T is less than TJ |
|---|---|---|---|
| Start supplying | | 1.14 | |
| during supplying | 1 | 1.12 | |
| during supplying | 2 | 1.08 | 1 |
| during supplying | 3 | 1.02 | 2 |
| during supplying | 4 | 0.98 | 3 |
| during supplying | 5 | 0.94 | 4 |
| during supplying | 6 | 0.94 | 5 |
| during supplying | 7 | 0.92 | 6 |
| during supplying | 8 | 0.90 | 7 |
| during supplying | 9 | 0.90 | 8 |
| suspend supplying | 10 | 0.90 | 9 |

(TJ: 1.11 sec.)

In FIG. 14, numeral 100*a* indicates an SL signal time curved line during the toner supplying operation; numeral 101*a* indicates a toner supplying start point; and numeral 102*a* indicates a toner supplying suspend point. In Table 1, after the toner supplying operation is started, the shift of the SL signal time gets stable for 0.9 second and does not change subsequently after the SL signal time T becomes less than TJ more than seven times. This stable time is defined as TFS. Therefore, the image recording apparatus can make a judgment that the SL signal time T is equal to TFS where the SL signal time T becomes less than threshold value TJ eight times after start of the supplying operation, so that the toner supplying operation can be suspended.

Figure 15:
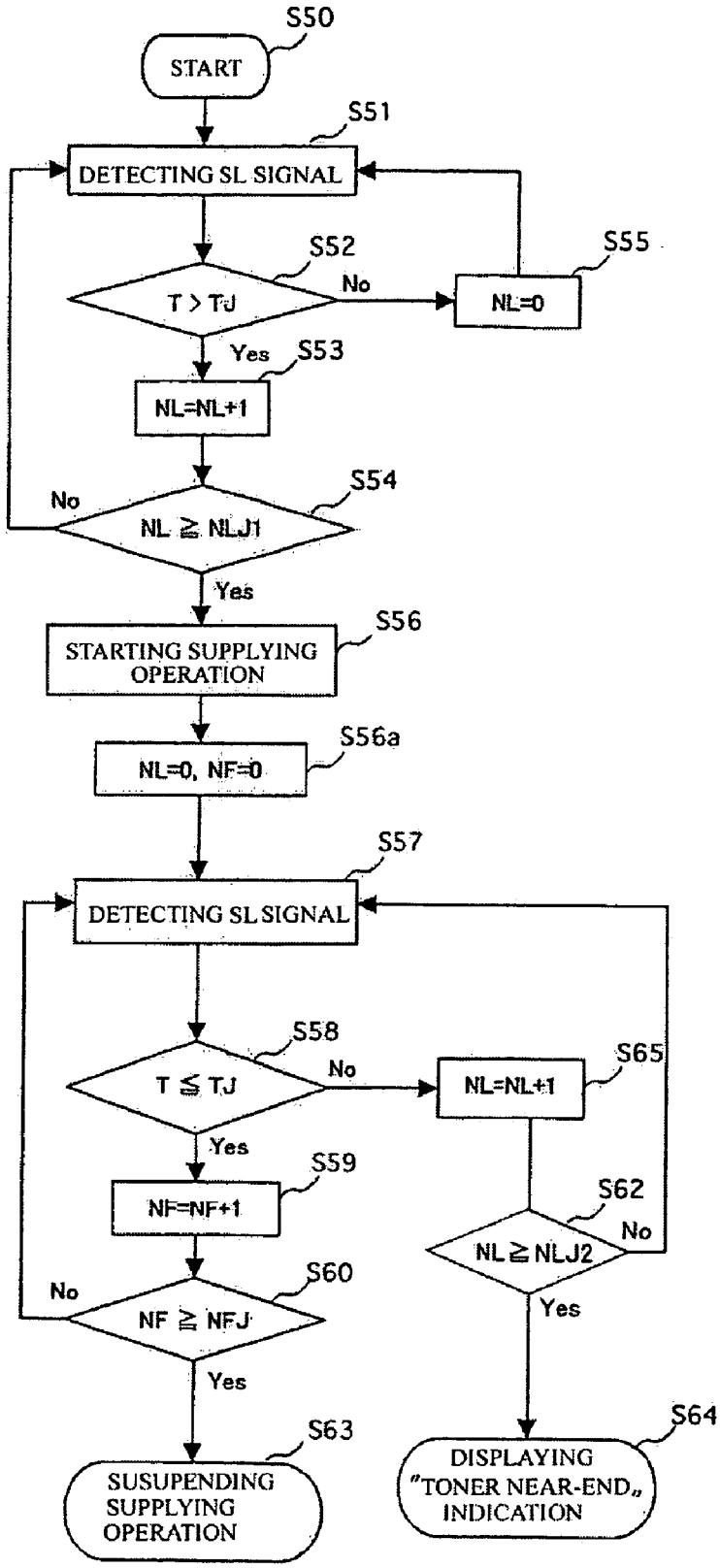
FIG. 15 is a flow chart showing control from start to suspend of toner supplying operation according to the first embodiment.

FIG. 15 is a flow chart showing control from start to suspend of toner supplying operation. Herein, a value NL indicates the number of times that the SL signal is detected; values NLJ1, NLJ2 indicate threshold limit values of the value NL; a value NF indicates the number of times that the SH signal is detected; and a value NFL indicates a threshold limit value of the value NF. Where starting the printing operation, the SL signal time T is detected and subsequently a comparison is made at the step S52 between the detected SL signal time T and the threshold value TJ. The value NL is reset to zero at the step S55 where the threshold value TJ is greater than or equal to the SL signal time T. The value NL is increased by one at the step S53 where the SL signal time is greater than the threshold value TJ and subsequently a comparison is made between the value NL and the value NLJ1 at the step S54. In this bout, if the value NL is less than the value NLJ1, the operation returns to the step S51. That is, the operation goes from the step S54 to the step S56 to start the toner supplying operation where the status of the SL signal time T greater than the threshold value TJ is continuously counted as many times as the value NLJ1 at the step S52. The values NL, NF are subsequently reset to zero at the step S56*a* and the SL signal time T is detected at the step S57. If the SL signal time T is less than or equal to the threshold value TJ at the step S58, the value NF is increased by one at the step S59. The toner supplying operation is suspended at the step S63 if the value NF is greater than the value NFJ at the step S60. At this time, if the SL signal time T is greater than the threshold value TJ at the step S58, the value NL is increased by one at the step S61 and if the value NL is less than the value NLJ2 at the step S62, the operation returns to the step S57. Furthermore, a judgment is made that the toner is not supplied where the value NL is greater than or equal to the value NJL2, so that the toner is supposed not to be remained inside the developer container 22. Consequently, the toner is remained only in the toner hopper 18*a* of the developing device 11, so that the image recording apparatus displays at the step S64 such a "toner near-end" indication as indicating that the toner remaining in the developer container 22 is close to zero.

With the control described above, the toner supplying operation gets stable, and the amount of toner remaining inside the developing device 11 can shift within a predetermined range at all times since the toner supplying operation is suspended based on assumption of time when the SL signal time T becomes stable, not suspended immediately after the SL signal time T is less than or equal to the threshold value during the toner supplying operation. That is, the image recording apparatus capable of printing stably without causing blurs can be provided.

A method for determining the value NLJ1 is described next.

In the above case, where a detecting period from when the SL signal time T is greater than the threshold value TJ to when the toner supplying operation is started is set to TK, equality of TK=TC*NLJ1 is satisfied. In this bout, on the condition where a maximum toner consumption rate for printing is set to Cmax while a toner supplying speed is set to Sp, the time TK is set so that expression of (Sp/Cmax)*TC>TK is satisfied. Consequently, the toner consumed during the detecting time TK is supplied during the time TC while the SL signal time T during the supplying operation becomes less than or equal to the threshold value TJ at the time of second time or at least third time rotation.

Therefore, the value NLJ1 is to be set so that inequality of NLJ1<Sp/Cmax is satisfied.

Upon setting the value NLJ1 as described above, the toner such as consumed during the detecting period can be supplied up to the threshold value amount during the time TC after starting the supplying operation, so that a toner supplying period can be shortened while the toner supplying operation can be stable because of the toner consumption during the time TK.

Figure 16:
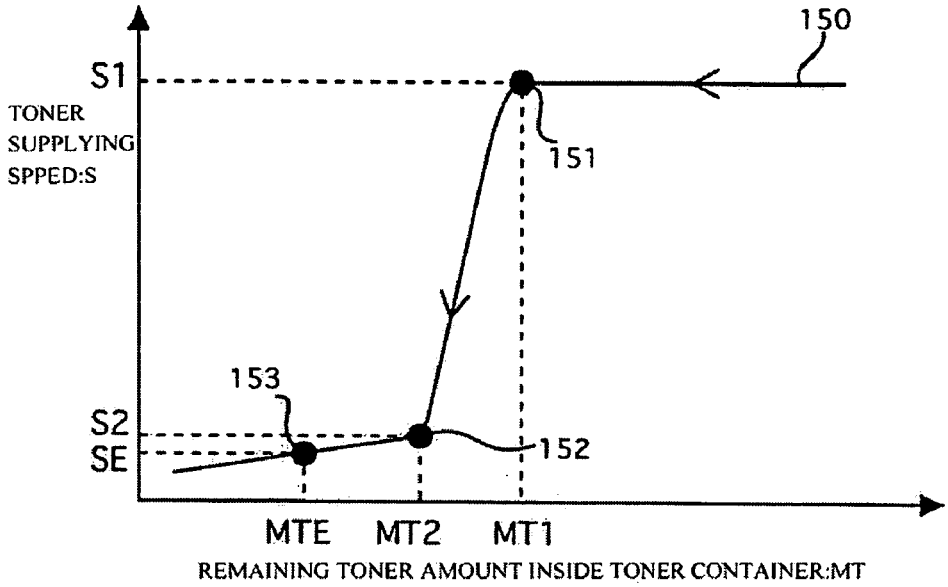
FIG. 16 is a chart showing a relation between the amount of toner remaining inside the developer container and toner supplying speed according to the second embodiment.

Described next in reference to FIG. 15 and FIG. 16 is a method for making a judgment as to indications of "toner near-end" and "toner end" for indicating the status where the toner runs out inside the developer container.

In FIG. 16, a relation between the remaining toner amount MT inside the developer container 22 and toner supplying speed S is indicated by a curved line 150, in which the toner supplying speed S stays substantially constant a point until the curved line 150 reaches at a point 151 (MT1, S1). However, the toner supplying speed S slows down sharply from the inflection point 151 to a point 152 (MT2, S2). A judgment is made at the point 152 that the toner 30 runs low inside the developer container 22 based on the state where the toner supplying speed sows down, so that the "toner near-end" indication is displayed. Subsequently, the supplying speed further slows down to reach speed SE, and in this bout, a judgment is made that the toner runs out inside the developing device 11, thereby displaying the "toner end" indication. The image recording apparatus hereby requests a user to exchange the developer container 22 but rotates the supplying regulating member 20 to continue the toner supplying operation during a period from when displaying the "toner near-end" indication until when displaying the "toner end" indication.

The amount of toner remaining inside the developer container 22 can be reduced from MT2 to MTE at the time of the "toner end" indication upon continuous of the toner supplying operation during a period from when displaying the "toner near-end" indication until when displaying the "toner end" indication. That is, the amount of toner remaining inside the developer container 22 is reduced at the time of exchanging the developer container, thereby being able to utilize the toner effectively.

The second embodiment of this invention is described hereinafter

Structural portions of an operation detector 40*a* in FIG. 12 are substantially the same as those in the first embodiment, and for the sake of simplicity, those duplicated descriptions are omitted. A controller 40*b* operates differently from the first embodiment, so that this different operation is described in detail.

One threshold value TJ is set as the threshold value based on which a judgment as to the remaining toner of a small amount is made in the first embodiment, but in the second embodiment, the toner supplying operation is controlled using two threshold values, i.e., the first threshold value TJL based on which a judgment as to the remaining toner of a small amount is made and the second threshold value TJF based on which a judgment as to the remaining toner of a large amount is made.

At this time, the first threshold value TJL and the second threshold value TJF are set to satisfy inequality of TJF<TJL.

Figure 17:
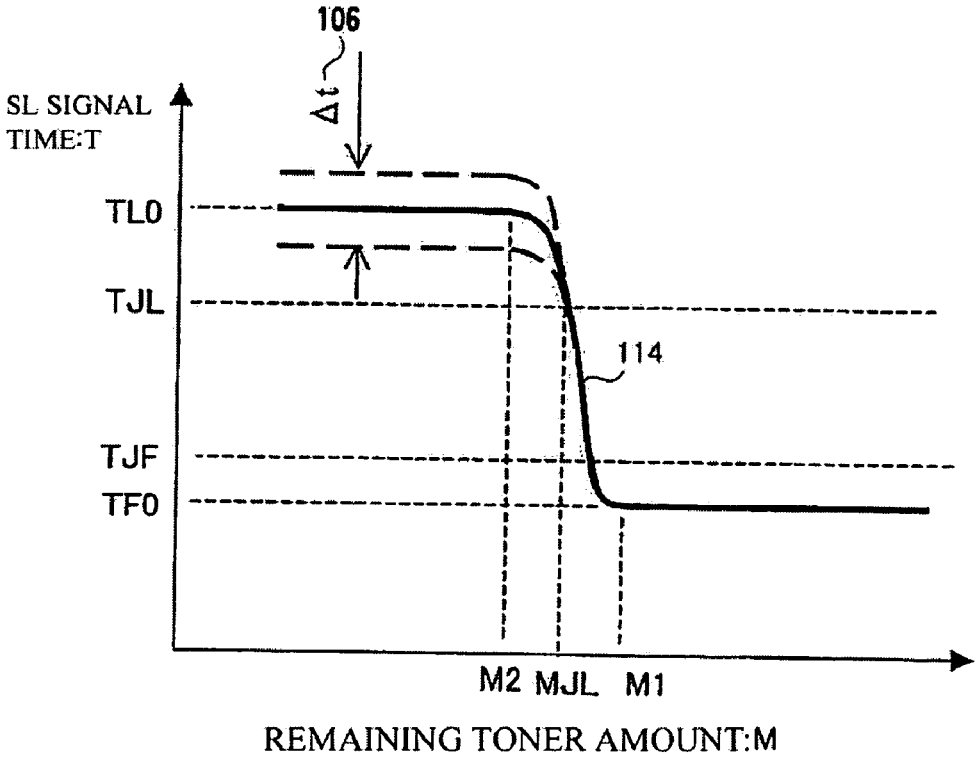
FIG. 17 is a chart showing a relation between the amount of toner remaining inside the toner hopper and an SL signal time according to the second embodiment.

On the condition that the amount of toner remaining inside the toner hopper 18*a* is defined as M, a relation between the remaining toner amount M and the SL signal time T is indicated by a curved line 114 such as shown in FIG. 17. That is, the SL signal time T includes a stable time TLO at the time of the remaining toner M of a small amount and a stable time TFO at the time of the remaining toner M of a large amount. Furthermore, the first threshold value TJF is set to around the time TFO while the second threshold time TJL is set to around the time TLO. Where the toner is consumed, when the toner remaining amount on the threshold value TJ is set to MJ on the condition that an inflection point of the stable stage TFO is set to (M1, TFO) while an inflection point of the stable stage TFO is set to (M2, TLO), inequality of M2<MJ<M1 is satisfied. Herein, any error is not observed in the stable time TFO since the stable time TFO is equal to the rotation period of the pushing section 33*a* while the stable time TFO does not always stay a certain value since the agitating member 19 falls spontaneously and receives extremely weak resistance force from the toner, with which the agitating member 19 still can reach the bottom position.

It is therefore necessary to consider that an error, i.e., Δt, is observed in the stable time TLO. Consequently, the threshold value TJ is to be set out of region 106 of the error Δt.

A control with the reflection sensor is described next in reference to FIG. 12.

The signal is converted into the SH signal and the SL signal where the reflection sensor reads the position 41 of the bottom position at which the agitating member is positioned, and subsequently the SL signal detector 44 detects a period during which the agitating member remains at the bottom position. Furthermore, the memory 45 memorizes the SL signal time, so that a comparator 47 makes a comparison among a rotation period, the threshold value read from the SL signal threshold value memory 46, and the SL signal time stored in the memory 45. The judging unit 48 makes a judgment based on the comparison result as to whether the toner remaining inside the toner hopper 18*a* is of a large or small amount. Where the remaining toner of a small amount is judged as a result of the judgment, the supplying driving instructor 49 gives the supplying start instruction to start the toner supplying operation.

Figure 18:
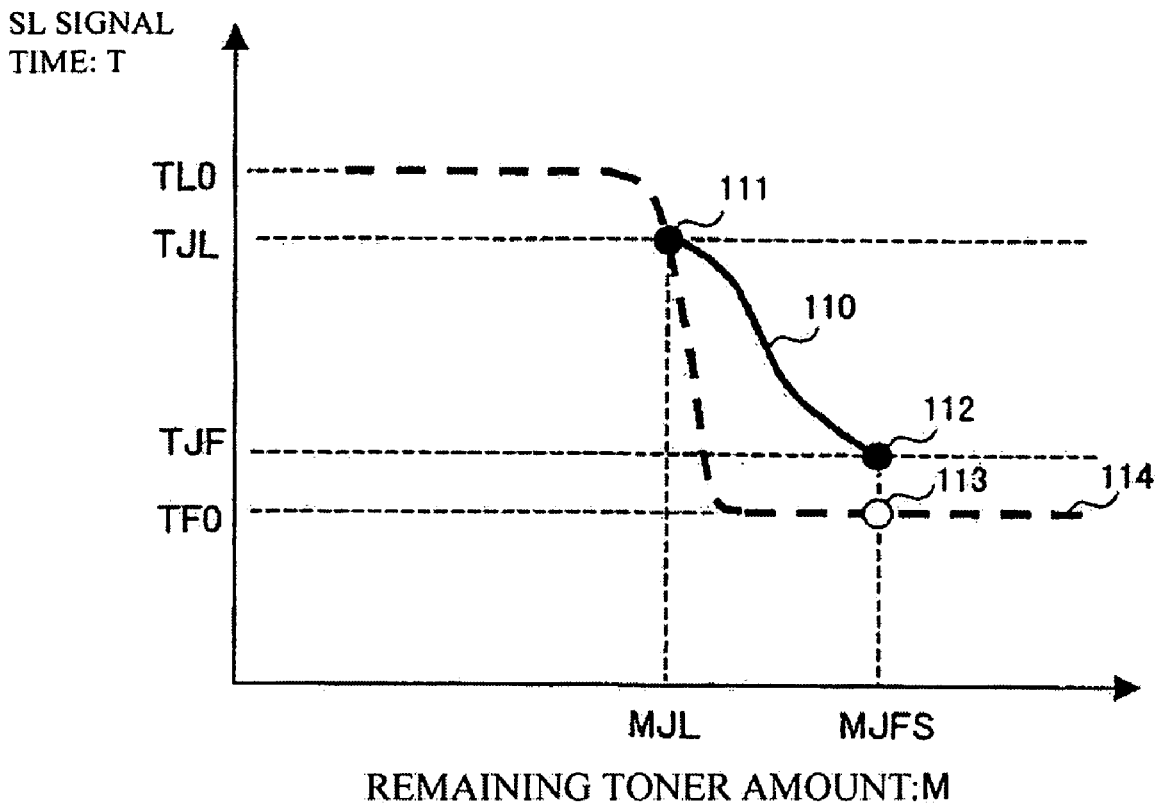
FIG. 18 is a chart showing a relation between the amount of toner remaining inside the developer container and an SL signal time according to the second embodiment.

The toner supplying operation is made where a small amount of toner remains inside the toner hopper 18*a*. A relation between the toner remaining amount inside the toner hopper 18*a* and the SL signal time during the toner supplying operation is shown in FIG. 18. A curved line 110 indicates the relation during the toner supplying operation, in which a point 111 is defined as a point at which the toner supplying operation is started while a point 112 is defined as a point at which the toner supplying operation is suspended. The toner supplying operation is started at the time that the SL signal time T is equal to the threshold value TJL and the curved line 110 in FIG. 18 shifts to the certain SL signal time TJF after certain period, and in this bout, the toner supplying operation is suspended. The curved line 110 shifts gradually to the point 113 since the toner is uniformly dispersed inside the toner hopper 18*a* after the toner supplying operation is suspended at a point (TJF, MJFS).

Figure 19:
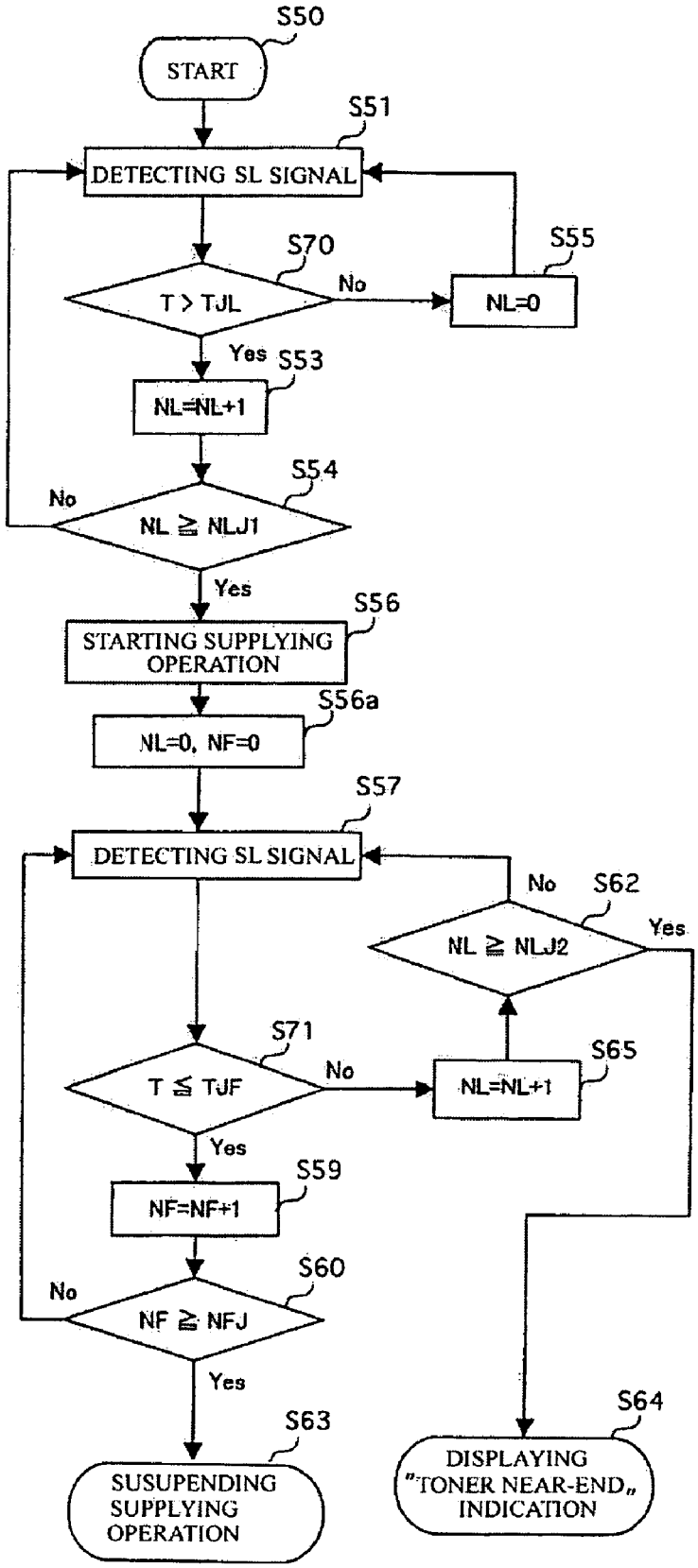
FIG. 19 is a flow chart showing control from start to suspend of the toper supplying operation according to the second embodiment.

FIG. 19 is a flow chart showing control from start to suspend of the toper supplying operation according to the second embodiment. Herein, the value NL indicates the number of times that the SL signal is detected; the values NLJ1, NLJ2 indicate the threshold limit values of the value NL; the value NF indicates the number of times that the SH signal is detected; and the value NFL indicates the threshold limit value of the value NF. Where starting the printing operation, the SL signal time T is detected and subsequently a comparison is made at the step S70 between the detected SL signal time T and the threshold value TJ. The value NL is reset to zero at the step S55 where the threshold value TJL is greater than or equal to the SL signal time T. The value NL is increased by one at the step S53 where the SL signal time is greater than the first threshold value TJL and subsequently a comparison is made between the value NL and the value NLJ1 at the step S54. In this bout, if the value NL is less than the value NLJ1, the operation returns to the step S51. That is, the operation goes from the step S54 to the step S56 to start the toner supplying operation where the status of the SL signal time T greater than the threshold value TJL is continuously counted as many times as the value NLJ1 at the step S70. The values NL, NF are subsequently reset to zero at the step S56*a* and the SL signal time T is detected at the step S57. If the SL signal time T is less than or equal to the threshold value TJF at the step S71, the value NF is increased by one at the step S59. The toner supplying operation is suspended at the step S63 if the value NF is greater than the value NFJ at the step S60. At this time, if the SL signal time T is greater than the threshold value TJL at the step S70, the value NL is increased by one at the step S61 and if the value NL is less than the value NLJ2 at the step S62, the operation returns to the step S57. Furthermore, a judgment is made that the toner is not supplied where the value NL is greater than or equal to the value NJL2, so that the toner is supposed not to be remained inside the developer container 22. Consequently, the toner is remained only in the toner hopper 18*a* of the developing device 11, so that the image recording apparatus displays at the step S64 such a "toner near-end" indication as indicating that the toner remaining in the developer container 22 is close to zero.

Not likewise the first embodiment, the control operation is made using two threshold values, TJL, TJF, thereby being able to simplify the supplying suspend operation in that speculation as to the stable SL signal time T is not required since the toner supplying operation can be suspended immediately after the SL signal time T becomes equal to the threshold value TJF during the toner supplying operation upon setting a great difference between the first threshold value TJL and the second threshold value TJF large. The remaining toner amount varies widely at each time of the suspend operation ascribable to external temperature and humidity even where stability of the SL signal time T is speculated likewise the first embodiment but the variation can be comparatively reduced. The toner supplying operation is stabilized upon immediately suspended based on the SL signal time T, so that the amount of toner remaining inside the developing device 11 can change within a predetermined range at all times. That is, the image recording apparatus capable of printing stably without causing blurs can be provided.

It is to be noted that this invention is not limited to the foregoing embodiments. This invention relates to a developer storage container for supplying developer to, e.g., a development apparatus of a reversal development type, an image recording apparatus using the development apparatus, or the like, as well as to the image recording apparatus, and is installed especially to an electrographic recording apparatus, but this invention is not limited to the electrographic recording apparatus but can be variously modified for application to apparatuses of a regular development type based on the purpose of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image recording apparatus for recording an image to a prescribed recording medium using a developer contained in a developer container comprising:

a developer supplying mechanism for supplying said developer from said developer container;

a developer containing chamber for containing said developer supplied by said developer supplying mechanism;

a developer amount detecting mechanism for detecting a developer amount inside said developer containing chamber; and a controller for controlling developer supplying operation using said developer supplying mechanism based on a detected value detected with said developer amount detecting mechanism and a predetermined threshold value, wherein said controller suspends said developer supplying operation using said developer supplying mechanism based on a shift in said detected value detected by said developer amount detecting mechanism in a state that said developer supplying mechanism supplies said developer.

2. The image recording apparatus according to claim 1, wherein said developer amount detecting mechanism has an agitating mechanism for agitating said developer inside said developer containing chamber and an operation detector for detecting operation of said agitating mechanism, and wherein a remaining developer amount is judged based on a detected result with said operation detector.

3. The image recording apparatus according to claim 2, wherein said agitating mechanism includes an agitating member rotatable upon reception of pushing force in a rotational direction of a driving unit rotating at a prescribed rate and rotatable freely without reception of driving force from said driving unit at a time of rotatably reaching up to a top position, and a pushing section for pushing said agitating member to a connection member for connecting said agitating member to said driving unit.

4. The image recording apparatus according to claim 2, wherein said operation detector has a sensor for sensing a period during which said agitating member remains at a bottom position, and wherein said controller makes a comparison between said period sensed with said detector during which said agitating member remains at said bottom position and a threshold value.

5. The image recording apparatus according to claim 4, wherein said operation detector detects prescribed times a status that said period during which said agitating member remains at said bottom position is less than said threshold value, and wherein said controller suspends said developer supplying operation using said developer supplying mechanism based on a shift in said detected values detected said prescribed times.

6. The image recording apparatus according to claim 4, wherein said operation detector detects multiple times said period during which said agitating member remains at said bottom position, and wherein said controller suspends said developer supplying operation using said developer supplying mechanism based on the shift in said detected values detected said multiple times.

7. The image recording apparatus according to claim 4, wherein said controller renders said developer supplying mechanism start said developer supplying operation where detecting a status that a value of said period sensed with said sensor during which said agitating member remains at said bottom position is greater than a first threshold value, and wherein said controller renders said developer supplying mechanism suspend said developer supplying operation where detecting a status that said period sensed with said sensor during which said agitating member remains at said bottom position is less than a second threshold value less than said first threshold in comparison between said period and said second threshold value.

8. An image recording apparatus for recording an image using a developer contained in a developer container comprising:

a developer supplying mechanism for supplying said developer from said developer container;

a developer containing chamber for containing said developer supplied by said developer supplying mechanism;

a developer amount detecting mechanism for detecting a developer amount inside said developer containing chamber; and a controller for having said developer supplying mechanism start a developer supplying operation and having said developer amount detecting mechanism continue detecting said developer amount when a detected value detected with said developer amount detecting mechanism reaches a predetermined threshold value and for having said developer supplying mechanism suspend said developer supplying operation based on a detected result of said developer amount detecting mechanism.

9. The image recording apparatus according to claim 8, wherein said controller detects said developer amount inside said developer container based on said detected value detected with said developer amount detecting mechanism when said developer supplying mechanism supplies said developer.

10. The image recording apparatus according to claim 9, wherein said controller makes a report of a developer near-end status based on said developer amount inside said developer container.

11. The image recording apparatus according to claim 10, wherein said controller continues said developer supplying operation using said developer supplying mechanism after detecting said developer near-end status.

12. The image recording apparatus according to claim 11, wherein said controller further detects a developer end status using developer amount detecting mechanism after detecting said developer near-end status.

13. The image recording apparatus according to claim 8, wherein said controller counts the number of times that said detected value detected with said developer detecting mechanism becomes less than or equal to said predetermined threshold value and then starts said developer supplying operation when said counted number of times reaches the predetermined number of times.

14. The image recording apparatus according to claim 8, wherein said controller counts the number of times that said detected value detected with said developer detecting mechanism becomes more than or equal to said predetermined threshold value at a time of said developer supplying operation using said developer supplying mechanism and then suspends said developer supplying operation when the counted number of times reaches the predetermined number of times.

15. The image recording apparatus according to claim 8, wherein said developer container is formed in a detachably attachable manner to said image recording apparatus and comprises an opening for supplying said developer into said developer containing chamber and an agitating mechanism for agitating said developer contained inside said developer container.

* * * * *